United States Patent [19]

Schubert et al.

[11] 3,961,633

[45] June 8, 1976

[54] METHOD AND MACHINE FOR THE PRODUCTION OF COMPOSITE FILTER MOUTHPIECES

[75] Inventors: Bernhard Schubert, Neu Boernsen; Otto Blidung, Geesthacht, both of Germany

[73] Assignee: Hauni-Werke Korber & co., KG, Hamburg, Germany

[22] Filed: June 27, 1974

[21] Appl. No.: 483,668

Related U.S. Application Data

[62] Division of Ser. No. 275,096, July 25, 1972, Pat. No. 3,834,285.

[30] Foreign Application Priority Data

| | | |
|---|---|---|
| July 26, 1971 | Germany | 2137318 |
| July 26, 1971 | Germany | 2137319 |
| Sept. 10, 1971 | Germany | 2145375 |

[52] U.S. Cl. ..... 131/94; 93/1 C; 131/20 R

[51] Int. Cl.[2] ..... A24C 5/48; A24C 5/58

[58] Field of Search ..... 93/1 C, 77; 131/20, 131/94

[56] References Cited

UNITED STATES PATENTS

| | | | |
|---|---|---|---|
| 1,784,296 | 12/1930 | Lorentz | 131/20 R X |
| 2,821,200 | 1/1958 | Korber | 131/94 |
| 2,994,251 | 8/1961 | Pollman | 93/1 C |
| 3,158,251 | 11/1964 | Skala et al. | 131/94 X |
| 3,308,832 | 3/1967 | Stelzer et al. | 131/20 R |
| 3,335,729 | 8/1967 | Ice | 131/10.7 X |
| 3,517,480 | 6/1970 | Pinkham | 93/1 C X |
| 3,603,058 | 9/1971 | Schubert | 93/1 C |

FOREIGN PATENTS OR APPLICATIONS

| | | | |
|---|---|---|---|
| 1,182,123 | 11/1964 | Germany | 131/94 |
| 740,329 | 11/1955 | United Kingdom | 131/10.7 |

*Primary Examiner*—Robert W. Michell
*Assistant Examiner*—V. Millin
*Attorney, Agent, or Firm*—Peter K. Kontler; John Kurucz

[57] ABSTRACT

Filter mouthpieces with one or more thin filter disks of first filter material and one or more filter plugs of second filter material are produced by inserting filter disks between groups of axially aligned tobacco rod sections and filter plugs and thereupon wrapping adhesive-coated uniting bands therearound.

9 Claims, 4 Drawing Figures

METHOD AND MACHINE FOR THE PRODUCTION OF COMPOSITE FILTER MOUTHPIECES

This is a division of application Ser. No. 275,096, filed July 25, 1972, now U.S. Pat. No. 3,834,285 granted Sept. 10, 1974.

BACKGROUND OF THE INVENTION

The present invention relates to a method and machine for the making of composite filter mouthpieces for cigarettes, cigars or cigarillos. More particularly, the invention relates to improvements in a method and machine for the manufacture of composite filter mouthpieces wherein a tubular envelope contains different types of filter material. Still more particularly, the invention relates to improvements in a method and machine for the production of filter mouthpieces wherein a tubular envelope contains one or more cylindrical plugs or wads and one or more disk-shaped elements of gas-permeable filter material and wherein the material of the filter plug or plugs is normally different from the material of the filter disk or disks.

The invention also relates to a method and machine for the making of rod-shaped smokers' products which embody the improved filter mouthpieces.

It is already known to provide cigarettes, cigars and/or cigarillos with composite filter mouthpieces which contain two or more different filter materials. It was found that a composite mouthpiece is often a more effective means for segregating from tobacco smoke substantial quantities of nicotine, tar and/or other deleterious ingredients. For example, it is known to employ filter mouthpieces wherein a tube contains a wad or plug of acetate fibers and a charge of granular filter material, e.g., activated carbon. It is also known to replace the charges of granular or powdery material with thin disk-shaped filters which consist of glass fibers alone or glass fibers impregnated with one or more chemicals. The relatively thin glass fiber disks are surprisingly effective as concerns their ability to absorb various harmful ingredients of tobacco smoke. However, such filter elements exhibit the serious drawback that they are much more difficult to assemble with other components, especially when the filter mouthpieces are to be produced at the rate of several thousand per minute. The problems in connection with the manipulation of relatively thin disk-shaped filters are attributed mainly to the small axial length of such filter elements as well as to the fact that they are readily deformable. As a rule, the material of filter disks is quite soft so that they are likely to be deformed to an extent which renders them useless in composite filter mouthpieces for cigarettes or the like. The problems in connection with the manipulation of filter disks are equally severe when the filter mouthpieces are to be assembled in the form of continuous filter rods which are thereupon subdivided into filter mouthpieces of desired length, when the components of filter mouthpieces are inserted into tubular envelopes which travel sideways, as well as when the filter mouthpieces are assembled and immediately attached to rod sections which constitute plain cigarettes, cigars or cigarillos.

SUMMARY OF THE INVENTION

An object of the invention is to provide a novel and improved method of producing composite filter mouthpieces which contain one or more disk-shaped filter elements according to which the assembly of filter mouthpieces can be completed at a high rate of speed, with a high degree of reproducibility and without any damage to or deformation of sensitive disk-shaped filter elements.

Another object of the invention is to provide a novel and improved method of producing filter mouthpieces which contain one or more disk-shaped filter elements.

An additional object of the invention is to provide a novel and improved method of producing filter-tipped rod-like smokers' products wherein the mouthpieces contain one or more disk-shaped filter elements.

Another object of the invention is to provide a novel and improved machine for the production of filter-tipped cigarettes, cigars or cigarillos each of which embodies a filter mouthpiece having one or more disk-shaped filter elements.

Another object of the invention is to provide a machine for the making and/or processing of filter mouthpieces having one or more disk-shaped filter elements which is constructed and assembled in such a way that it can turn out large quantities of mouthpieces per unit of time without, however, affecting the quality, appearance and/or integrity of filter disks.

An additional object of the invention is to provide the improved machine with novel and improved means for producing and/or manipulating disk-shaped filter elements for use in composite filter mouthpieces which contain several types of filter material.

Still another object of the invention is to provide a machine for the making of filter mouthpieces containing one or more disk-shaped filter elements which can produce such mouthpieces with minimal waste in filter material and which can assemble filter mouthpieces at the rate required to meet the requirements of a modern high-speed filter cigarette making or like machine.

A feature of the invention resides in the provision of a method of making filter-tipped rod-shaped smokers' products, such as filter cigarettes. The method comprises the steps of moving a succession of wrapped tobacco rod sections (e.g., plain cigarettes of unit length) sideways, placing filter plugs into axial alignment with successive tobacco rod sections and moving the thus obtained groups sideways, placing filter disks between the filter plugs and tobacco rod sections of successive groups, and convoluting adhesive-coated uniting bands around the filter plugs, filter disks and tobacco rod sections of successive groups. The second placing step may comprise locating each filter disk in abutment with that end of the respective tobacco rod section which faces the axially aligned filter plug. The first placing step may comprise locating each filter plug in spaced apart position relative to the respective tobacco rod section so that the distance between the filter plug and the aligned tobacco rod section exceeds the thickness of a filter disk. This insures that a space remains between each filter disk and the axially aligned tobacco rod section and/or filter plug.

The filter disk placing step preferably comprises holding the filter disks at one axial end thereof during introduction between the filter plugs and tobacco rod sections of the respective groups. The holding step preferably comprises holding the filter disks by suction.

The method may further comprise the step of attracting the filter disks to the tobacco rod sections of the respective groups by means of suction air streams acting through the tobacco rod sections, at least prior to start of the convoluting step.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

Figure 1:
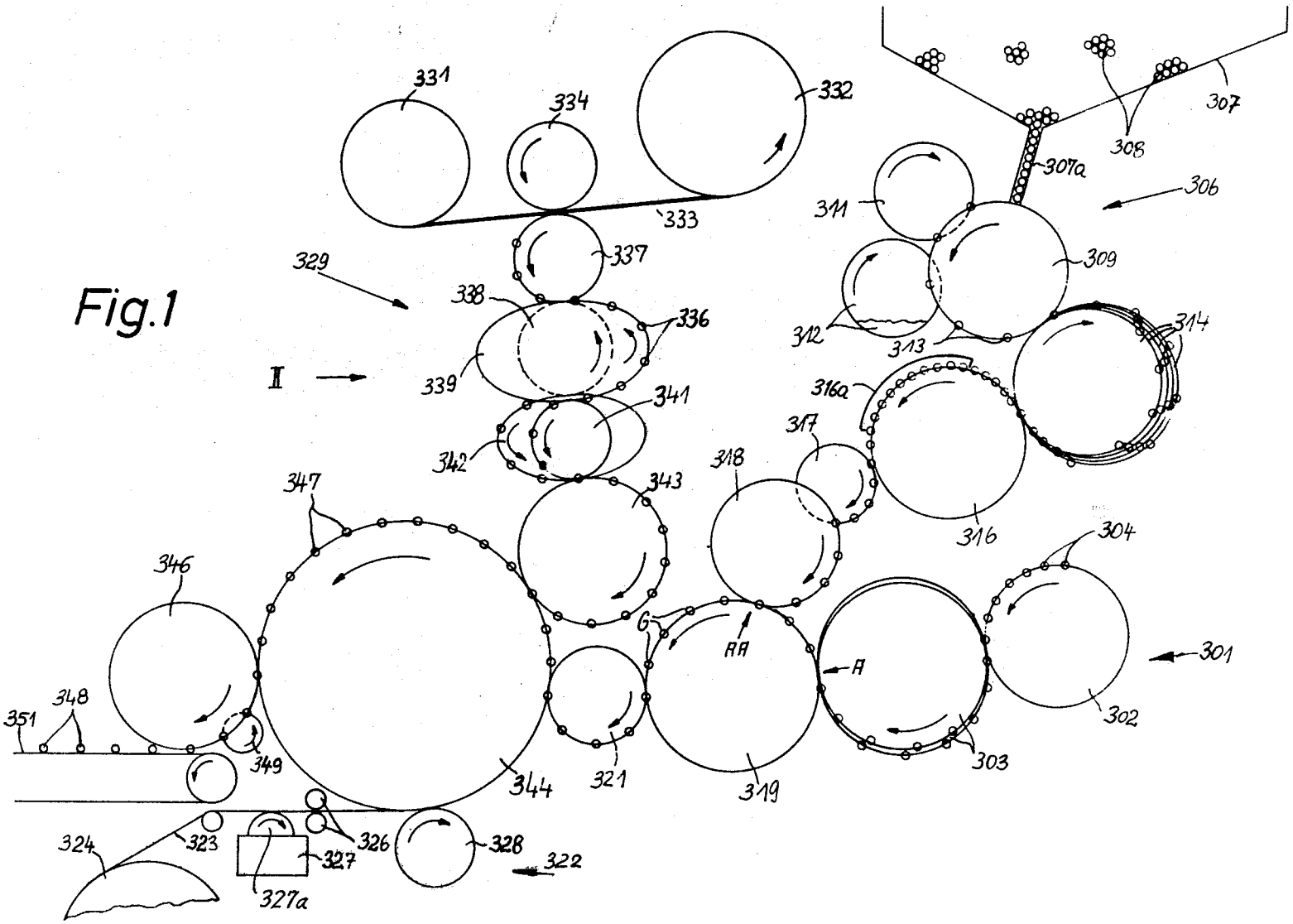
FIG. 1 is a schematic side elevational view of a filter cigarette making machine which embodies a filter mouthpiece making machine.

Referring now to FIG. 1, there is shown a filter cigarette making machine which comprises a first feeding unit 301, a second feeding unit 306, a third feeding unit 322 and a fourth feeding unit 329. The feeding unit 301 comprises a transfer conveyor 302 which is a rotary drum having axially parallel peripheral flutes for reception of discrete plain cigarettes 304 of unit length. The transfer conveyor 302 receives such cigarettes from a cigarette rod making machine which is not shown in FIG. 1. The machine which delivers plain cigarettes 304 to the transfer conveyor 302 can be of the type shown as GARANT produced by the West-German Firm of Hauni-Werke, of Hamburg-Bergedorf. The cigarettes 304 on the transfer conveyor 302 form two rows one of which includes the first, third, etc. cigarettes and is adjacent to one axial end of the conveyor 302. The other row includes the second, fourth, etc. cigarettes 304 and is adjacent to the other axial end of the conveyor 302.

The transfer conveyor 302 rotates continuously in the direction indicated by arrow and delivers successive plain cigarettes 304 of the two rows into the flutes of two aligning conveyors 303 which are rotated in a clockwise direction, as viewed in FIG. 1. The conveyors 303 are two discrete drums which transport the cigarettes 304 of the respective rows in such a way that, when reaching a transfer station A, successive plain cigarettes 304 in the flutes of one of the conveyors 303 are in axial alignment with successive plain cigarettes 304 in the flutes of the other conveyor 303. At the transfer station A, the thus obtained pairs of axially aligned plain cigarettes 304 are transferred into successive flutes of an assembly conveyor 319 which is driven to rotate in a counterclockwise direction, as viewed in FIG. 1. The distance between the plain cigarettes 304 of pairs of coaxial cigarettes in the flutes of the assembly conveyor 319 exceeds the axial length of a filter plug 313 of double unit length.

The second feeding unit 306 comprises a magazine or hopper 307 which stores a substantial supply of parallel filter rod sections 308 of 8 times unit length. The magazine 307 has an inclined duct or chute **307*a* which can accommodate a stack of parallel filter rod sections 308 and delivers such sections into successive flutes of a rotary cutting conveyor 309. The conveyor 309 transports successive filter rod sections 308 past a first rotary disk-shaped knife 311 which subdivides each filter rod section into two filter rod sections of four times unit length. The thus obtained filter rod sections of four times unit length are thereupon transported past two coaxial rotary disk-shaped knives 312 which subdivide the filter rod sections of four times unit length into pairs of coaxial filter plugs 313 of double unit length. The filter plugs 313 are thereupon transferred onto four shuffling conveyors 314 which transport the respective plugs 313 through distances of different length and/or at different speeds so as to stagger the filter plugs circumferentially in a manner as shown in FIG. 1. The thus staggered filter plugs 313 are transferred into successive flutes of an aligning conveyor 316 which cooperates with cams 316*a* (only one shown) in order to move at least some of the plugs 313 axially and to form a single row of plugs which are located exactly one behind the other and travel sideways toward a transfer conveyor 317. The latter transfers the plugs 113 of the single row into successive flutes of an accelerating conveyor 318 which transfers successive plugs 313 into successive flutes of the assembly conveyor 319. The station where the filter plugs 313 are introduced into successive flutes of the conveyor 319 is shown at AA. The mounting of the accelerating conveyor 318 is such that each filter plug 313 is inserted into the gap or space between a pair of coaxial plain cigarettes 304. Thus, once a flute of the assembly conveyor 319 advances beyond the transfer station AA, it contains a group G of three coaxial rod-shaped articles including a centrally located filter plug 313 of double unit length and a pair of plain cigarettes 304 of unit length which are located at the opposite axial ends of the respective filter plug 313**.

Figures 2, 4:
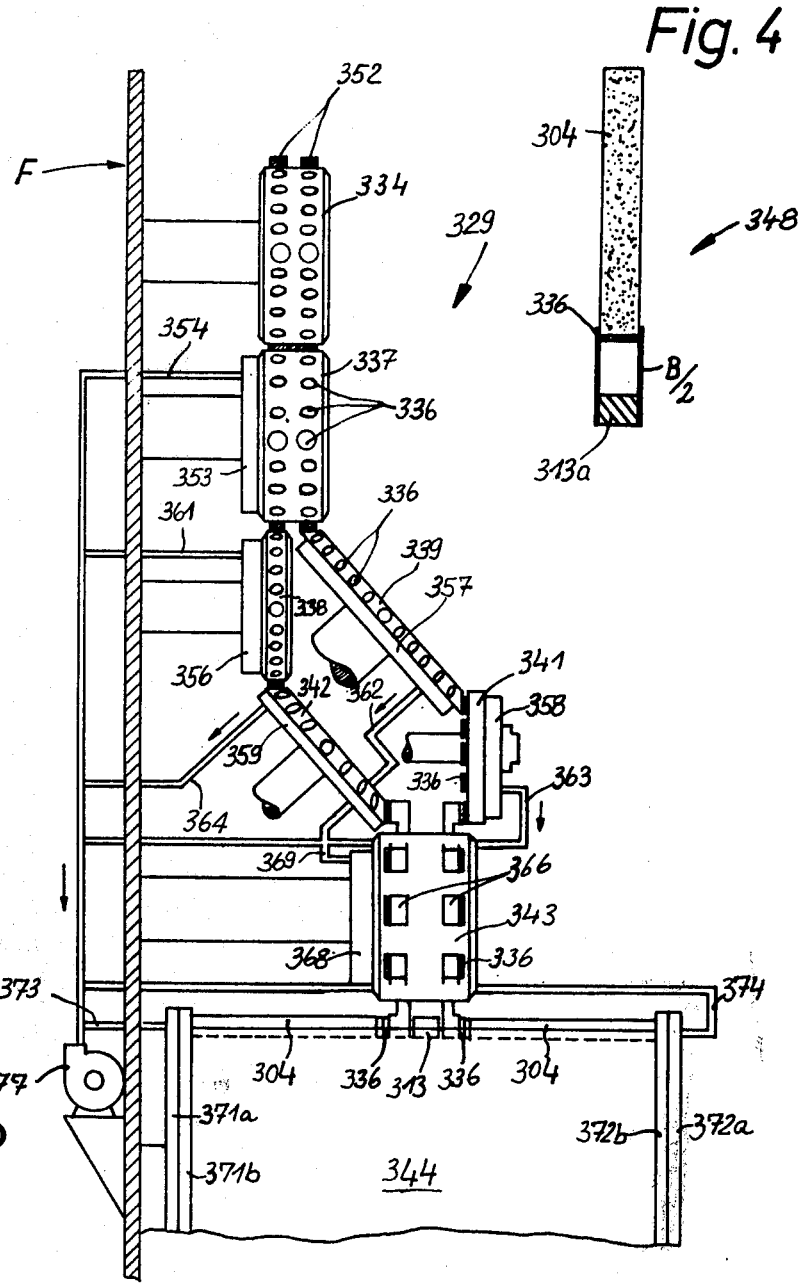
FIG. 2 is an enlarged side elevational view of a filter disk forming and feeding unit in the machine of FIG. 1, substantially as seen in the direction of arrow II.
FIG. 4 is an axial sectional view of a filter cigarette of unit length which is manufactured in the machine of FIG. 1.
Figure 3:
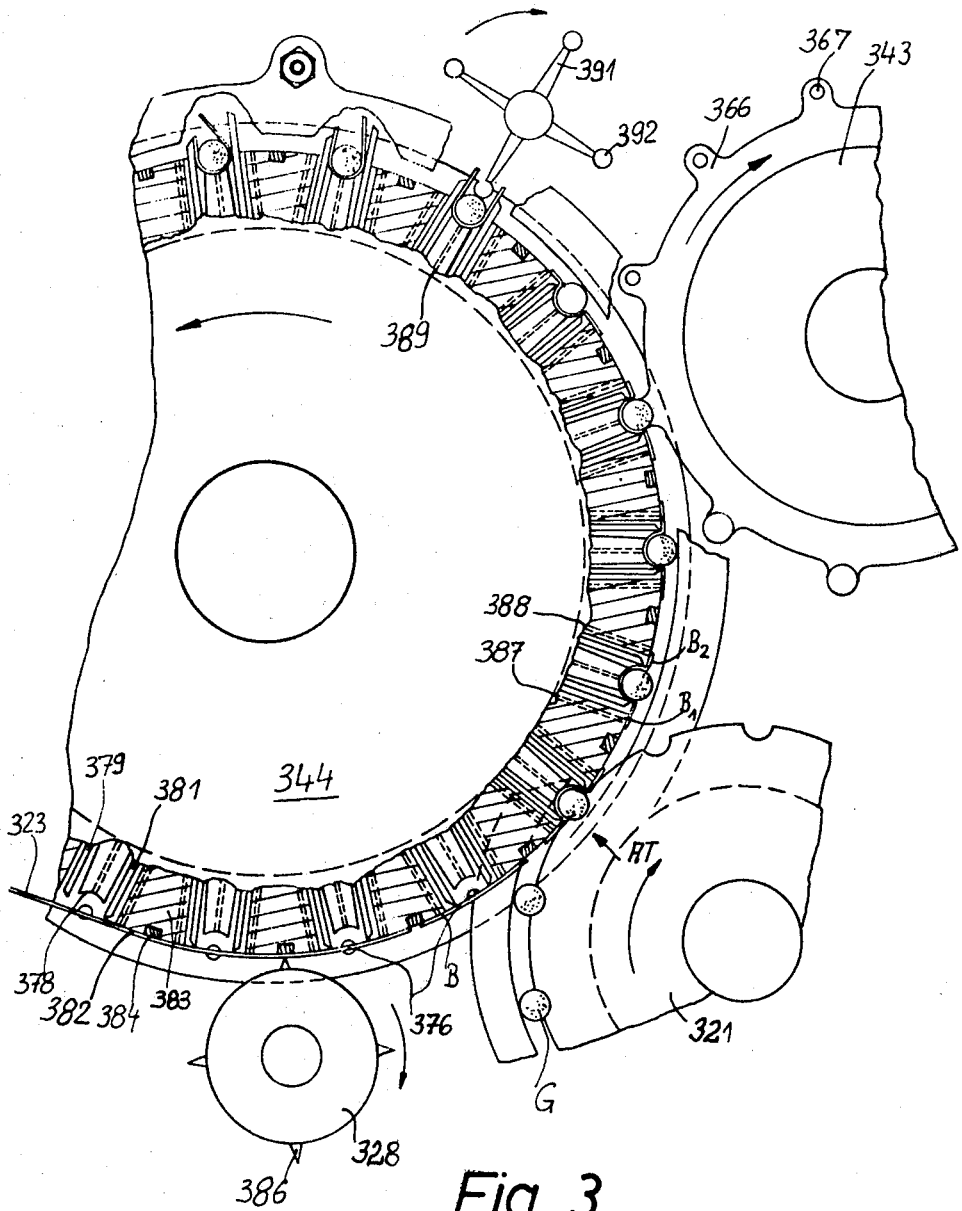
FIG. 3 is an enlarged transverse vertical sectional view of a wrapping conveyor in the machine of FIG. 1.

The assembly conveyor 319 delivers successive groups G into the flutes of a transfer conveyor 321 which delivers such groups to a wrapping conveyor 344 the details of which are illustrated in FIGS. 2 and 3.

The fourth feeding unit 329 comprises a roll or bobbin 331 of filter material 333 which can be converted into flat filter disks 336. The filter material 333 constitutes an elongated strip or tape which is collected by a continuously driven takeup reel 332 whereby an elongated portion of the material 333 travels in the space between the bobbin 331 and the reel 332. Such portion of the material 333 is acted upon by the stamping or punching tools 352 of a tool carrier 334 located opposite a transfer conveyor 337. The details of the feeding unit 329 are best shown in FIG. 2. It will be noted that the tool carrier 334 is a wheel which rotates in a counterclockwise direction, as viewed in FIG. 1, and is provided with two rows of stamping tools 352. The circular cutting edges of the tools 352 remove from successive increments of the material 333 disk-shaped filters 336 which are attracted by suction to the periphery of the transfer conveyor 337.

The transfer conveyor 337 transports two discrete rows of filter disks 336 toward the peripheries of two first intermediate conveyors 338 and 339 best shown in FIG. 2. Each of the conveyors 338, 339 accepts the filter disks 336 of one row and respectively transfers such filter disks to a second intermediate conveyor 342, 341. The second intermediate conveyors 341, 342 deliver the filter disks 336 to a transfer conveyor 343 which, in turn, delivers the filter disks 336 to the wrapping conveyor 344.

The third feeding unit 322 of the filter cigarette making machine shown in FIG. 1 comprises a supply 324 of convoluted paper web 323 which is being withdrawn by a pair of cooperating advancing rolls 326. The underside of the web 323 is coated with a suitable adhesive during travel past the rotary applicator 327*a* of a conventional paster 327. The thus coated leading end of the strip 323 is severed by a rotary knife 328 which is provided with equidistant blades 386 (see FIG. 3) serving to subdivide the strip 323 into discrete uniting bands B also shown in FIG. 3. Such bands are convoluted around the groups G on the wrapping conveyor 344 subsequent to introduction of a filter disk 336 into the gap between a filter plug 313 and the adjacent end of a plain cigarattc 304. It will be noted (see the lower portion of FIG. 2) that each group G receives two filter disks 336 prior to convolution of a uniting band B therearound. The convoluted bands B form tubes which convert the respective groups G into filter cigarettes 347 of double unit length. Such filter cigarettes are thereupon transferred onto a cutting conveyor 346 which has axially parallel flutes and transports the cigarettes 347 past a rotary disk-shaped knife 349 serving to subdivide each filter cigarette 347 into a pair of filter cigarettes 348 of unit length. The knife 349 severs the cigarettes 347 midway between their ends and halfway across the respective composite filter mouthpieces of double unit length. The pairs of filter cigarettes 348 of unit length are transferred onto the upper stretch of a conveyor belt 351 which transports the cigarettes 348 to storage, to a tray filling apparatus or directly into a packing machine, not shown.

FIG. 4 shows in axial section one complete filter cigarette 348 of unit length. It will be seen that this cigarette comprises a plain cigarette 304 of unit length, a filter disk 336 which is immediately adjacent to one axial end of the plain cigarette 304, a filter plug 313*a* of unit length which is axially spaced from the disk 336, and one half B/2 of a convoluted uniting band B.

Referring to FIG. 2, the conveyors of the feeding unit 329 are mounted in a frame F so that the filter disks 336 are transported downwardly from the carrier 334 toward the wrapping conveyor 344. The carrier 334 is rotated at a constant speed and is provided with internally mounted helical or otherwise configurated springs (not shown) which bias the stamping tools 352 radially outwardly. Each tool 352 is a tubular metallic body the outer end of which is provided with a circumferentially complete cutting edge which separates from the strip of filter material 333 a disk 336 during travel past the transfer conveyor 337. The latter constitutes a counterknife which is provided with a cylindrical peripheral surface consisting of hard metal and formed with a large number of suction ports (not shown) which attract the freshly separated filter disks 336 to the transfer conveyor 337 during transport toward the first intermediate conveyors 338 and 339. One axial end of the transfer conveyor 337 is adjacent to a stationary valve plate 353 which is provided with one or more suitably configurated arcuate grooves connected with a suction generating device 377 (e.g., a fan) by way of a conduit 354. The groove or grooves in the right-hand end face of the valve plate 353 communicate with the suction ports of the transfer conveyor 337 while such ports travel between the station where the filter disks 336 are being stamped and the station where the filter disks 336 are being transferred onto the intermediate conveyors 338 and 339.

The intermediate conveyor 338 is a cylinder one end face of which rotates adjacent to a stationary valve plate 356 having one or more arcuate suction grooves (not shown) connected with the suction generating device 377 by a conduit 361. The cylindrical peripheral surface of the intermediate conveyor 338 is provided with a large number of preferably small suction ports (not shown) which communicate with the groove or grooves of the valve plate 356 during transport of filter disks 336 from the transfer conveyor 337 to the intermediate conveyor 342. The intermediate conveyor 339 is a frustom of a cone and its conical peripheral surface is provided with suction ports (not shown) which communicate during a certain stage of their travel about the axis of the conveyor 339 with one or more grooves (not shown) provided in a stationary valve plate 357 adjacent to the base of the conveyor 339. The groove or grooves of the valve plate 357 are connected with the suction generating device 377 by a conduit 362. The ports of the intermediate conveyor 339 attract the filter disks 336 during transport of such disks from the cylindrical peripheral surface of the transfer conveyor 337 to the intermediate conveyor 341. The intermediate conveyor 342 is frustoconical similar to the conveyor 339 and is provided in its conical peripheral surface with suction ports (not shown) communication during a certain stage of their orbital movement with one or more arcuate grooves provided in the right-hand end face of a stationary valve plate 359. The groove or grooves of the valve plate 359 communicate with the suction generating device 377 by way of a conduit 364. The intermediate conveyor 341 is a short cylinder one end face of which is provided with an annulus of suction ports (not shown). The other end face of the intermediate conveyor 341 rotates relative to a stationary valve plate 358 having one or more arcuate suction grooves (not shown) which are connected with the suction generating device 377 by way of a conduit 363. The ports of the conveyor 341 communicate with the groove or grooves of the valve plate 358 during transport of filter disks 336 from the conical peripheral surface of the intermediate conveyor 339 to the transfer conveyor 343.

The transfer conveyor 343 is provided with two rows of holders 366 having suction heads which can retain the filter disks 336 in such positions that the planes of the filter disks on the suction heads of holders 366 are located at right angles to the axis of rotation of the conveyor 343. The right-hand end faces of the suction heads on holders 366 which are adjacent to the right-hand axial end of the transfer conveyor 343, as viewed in FIG. 2, are provided with suction ports 367 (see FIG. 3) which can attract the filter disks 336 during transport from the intermediate conveyor 341 into successive flutes of the wrapping conveyor 344. Analogously, the left-hand end faces of the suction heads on the left-hand row of holders 366, as viewed in FIG. 2, are provided with suction ports which attract filter disks 336 during transport from the intermediate conveyor 342 into successive flutes of the wrapping conveyor 344. The left-hand end face of the transfer conveyor 343 rotates relative to a stationary valve plate 368 having in its right-hand end face one or more arcuate grooves (not shown) connected to the suction generating device 377 by a conduit 369. The groove or grooves of the valve plate 368 communicate with the ports 367 of suction heads of holders 366 while such suction heads transport filter disks 336 to the wrapping conveyor 344.

The wrapping conveyor 344 is flanked by two stationary valve plates 371*a*, 372*a* which are outwardly adjacent to rotary retaining or stop rings 371*b*, 372*b*, respectively. The valve plates 371*a*, 372*a* are respectively connected with the suction generating device 377 by conduits 373, 374. Each of these valve plates is provided with a suction groove (not shown) which can attract the adjacent plain cigarettes 304 in the flutes of the wrapping conveyor 344. The rings 371*a*, 372*b* have suction ports or bores 376 which connect the grooves of the valve plates 371*a*, 372*a* with the flutes 378 for plain cigarettes 304 in the wrapping conveyor 344. The bores or ports 376 of the ring 371*b* are shown in FIG. 3.

The details of the wrapping conveyor 344 are illustrated in FIG. 3. This conveyor is of the type disclosed, for example, in German patents Nos. 1,157,525 and 1,182,123. Each receiving means or flute 378 extends in parallelism with the axis of rotation of the conveyor 344. This conveyor has a cylindrical body which is provided with pairs of radially extending cutouts for cooperating rolling or wrapping plates 379, 381. Each pair of rolling plates 379, 381 flank a flute 378. As disclosed in the aforementioned German patents, the rolling plates 379, 381 can be moved together with as well as relative to each other in the radial direction of the wrapping conveyor 344 to thereby effect a controlled wrapping of uniting bands B around the groups G in the respective flutes 378. The rolling plates 379, 381 are mounted in the central portion of the cylindrical body of the conveyor 344 and are wide enough to be capable of convoluting the entire uniting bands B in the respective flutes 378. When the rolling plates 379, 381 are fully retracted into the cylindrical body of the conveyor 344, they do not project outwardly beyond the lands 382 which extend between neighboring flutes 378. The lands 382 are provided on the cylinder portions 383 of the conveyor 344 and form an interrupted peripheral surface which supports the uniting bands B. As shown in FIG. 3, the bands B are formed by the blades 386 of the rotary knife 328 which cooperates with the lands 382 to sever the paper web 323 at regular intervals. It will be recalled that the outer side of the paper web 323 (as viewed in FIG. 3) has been coated with adhesive during travel past the applicator 327*a* of the paster 327 shown in FIG. 1. The portions 383 of the cylindrical body of the conveyor 344 together form a hollow drum which transports the uniting bands B in a counterclockwise direction, as viewed in FIG. 3. In order to reduce the wear on the lands 382, the portions 383 are preferably provided with axially parallel recesses for reception of relatively hard metallic inserts 384 which serve as counter-knives and cooperate with the edges of blades 386 to form clean cuts in the web 323 whereby the leading end of the web yields a succession of uniting bands B.

FIG. 3 further shows that the conveyor portions 383 are provided with radially extending suction ports 387 and 388 which are adjacent to the neighboring rolling plates 379 and 381. The purpose of suction ports 387, 388 is to attract the respective ends of uniting bands B during certain stages of conversion of such bands into tubes of the filter cigarettes 347 of double unit length. Those ends of the uniting bands B which are respectively attracted by the suction ports 387, 388 are shown in FIG. 3, as at B1 and B2. The flutes 378 are also provided with suction ports, shown at 389, which serve to attract certain components of the groups G during conversion of such groups into filter cigarettes 347 of double unit length. The suction ports 389 form in each flute 378 a row which extends in the axial direction of the conveyor 344 so that the ports 389 can attract the two plain cigarettes 304 and the filter plug 313 of the respective group G. The machine of FIG. 1 further comprises a star-shaped rotary pressing member 391 which is shown in the upper portion of FIG. 3 and has four equidistant prongs provided with rounded outer end portions 392 serving to press successive groups G into the respective flutes 378 during certain stages of the wrapping operation.

The operation of the machine of FIGS. 1 to 3 is as follows:

The transfer conveyor 302 of the feeding unit 301 receives two rows of plain cigarettes 304 of unit length from a cigarette rod making machine (not shown) in such a way that each of its flutes contains a single cigarette 304 and that the cigarettes in successive flutes are staggered with respect to each other. The ciragettes of one row are transferred onto one of the aligning conveyors 303 and the cigarettes of the other row are transferred onto the other aligning conveyor 303. The front conveyor 303 of FIG. 1 moves its foremost cigarette 304 into axial alignment with the foremost cigarette 304 on the rear aligning conveyor 303 at the exact moment when such cigarettes reach the station A to be transferred into successive flutes of the assembly conveyor 319. The axially aligned cigarettes 304 in the flutes of the assembly conveyor 319 are spaced apart to provide room for filter plugs 313 and for pairs of filter disks 336.

The duct 307*a* of the magazine 307 delivers filter rod sections 308 of eight times unit length into successive flutes of the cutting conveyor 309 which cooperates with the knife 311 and knives 312 to subdivide each section 308 into a set of four coaxial filter plugs 313 of double unit length. The flutes of the four shuffling conveyors 314 receive one filter plug 313 of each set and move the filter plugs sideways with as well as relative to each other so that the filter plugs 313 are staggered in the circumferential direction of conveyors 314 and can be delivered into successive flutes of the aligning conveyor 316. The latter cooperates with the cams 316*a* to move at least three of each original set of four filter plugs axially so as to convert the filter plugs into a single row with each filter plug located exactly behind the preceding filter plugs. The filter plugs 313 of the thus obtained row are transferred into successive flutes of the transfer conveyor 317 and are taken over by the accelerating conveyor 318 which delivers them into spaces between pairs of coaxial plain cigarettes 304 in successive flutes of the assembly conveyor 319. The insertion of filter plugs 313 takes place at the station AA. The thus obtained groups G are moved sideways and are introduced into successive flutes of the transfer conveyor 321 which delivers them into successive receiving means or flutes 378 of the wrapping or rolling conveyor 344.

The assembly conveyor 319 or the transfer conveyor 321 preferably cooperates with suitable cams (similar to the cams 316*a*) to move successive pairs of coaxial plain cigarettes 304 toward each other so as to provide between the filter plug 313 and the plain cigarettes 304 of each group G two spaces or gaps of predetermined width as shown in the lower portion of FIG. 12.

The advancing rolls 326 of the feeding unit 322 draw the paper web 323 from the roll 324 and move the underside of the web along the rotating applicator 327*a* of the paster 327. The leading end of the thus coated web 323 is attracted to the lands 382 of the wrapping conveyor 344 by suction ports 387, 388 and is severed by the blades 386 of the continuously rotating knife 328 so as to yield a series of adhesive-coated uniting bands B which continue to adhere to the periphery of the conveyor 344. As shown in FIG. 3, the front and rear ends B2 and B1 of successive uniting bands B are attracted by the adjoining suction ports 388, 387 so that the median portion of each band B overlies the respective flute 378. The transfer conveyor 321 delivers groups G into successive flutes 378 at the transfer station AT shown in FIG. 3 and presses such groups into the respective flutes with attendant deformation of uniting bands B; however, the leading and trailing ends B2, B1 of such uniting bands continue to overlie and are attracted by the adjacent ports 388, 387. The ends B2, B1 slip along the respective lands 382 during forcible insertion of groups G into the respective flutes 378 but the suction ports 387, 388 are drilled into the cylindrical body of the conveyor 344 in such positions that they are also capable of attracting the ends of the bands B downstream of the transfer station AT.

The continuously driven takeup reel 332 of the feeding unit 329 draws the strip 333 of filter material off the roll 331 and the continuously rotating carrier 334 causes its tools 352 to remove from the strip 333 two rows of filter disks 336 which are attracted by the transfer conveyor 337 (see FIG. 2) and delivered to the intermediate conveyors 338, 339. The conveyors 338, 339 respectively deliver filter disks 336 to the intermediate conveyors 342, 341 and the conveyors 341, 342 deliver the filter disks to the suction heads of successive pairs of holders 366 on the transfer conveyor 343. As shown in FIG. 2, the suction head of each holder 366 attracts one end face of the respective filter disk 336 during transfer into the adjoining flute 378 of the wrapping conveyor 344. The holders 366 deliver to each flute 378 a pair of coaxial filter disks 336 in such a way that each disk 336 enters one of the two spaces between the filter plug 313 and the respective plain cigarettes 304.

Suction in the bores 376 is controlled by the valve plates 371*a*, 372*a* in such a way that, once the filter disks 336 are inserted into a flute 378, they are attracted to the inner ends of the adjacent plain cigarettes 304 by suction air streams which flow outwardly through such cigarettes and toward the rings 371*b*, 372*b*. The thus completed groups G thereupon advance past the pressing member 391 and are pressed into their flutes 378 by successive rounded end portions 392 while the respective rolling plates 379, 381 move outwardly to start the draping of uniting bands B around the adjacent filter plugs 313, pairs of filter disks 336 and the inner ends of the respective pairs of plain cigarettes 304. The plate 381 is thereupon moved radially inwardly while the plate 379 moves radially outwardly (see the upper portion of FIG. 3) with the result that the ends B2 of successive uniting bands B are completely convoluted around the adjacent portions of the respective groups G. In the next step, the plates 381 are moved outwardly while the plates 379 move inwardly in a manner not shown in FIG. 3 to thus complete the conversion of successive uniting bands B into tubes which sealingly connect the thus obtained mouthpieces of double unit length to the respective pairs of plain cigarettes 304. The resulting filter cigarettes 347 of double unit length are transferred onto the cutting conveyor 346 which cooperates with the rotary knife 349 to sever each cigarette 347 midway between its ends so that each cigarette 347 yields two filter cigarettes 348 of unit length. The cigarettes 348 are transferred onto the conveyor belt 351 for delivery to storage, to a tray filling apparatus or directly to a packing machine. One row of filter cigarettes 348 is preferably inverted end-for-end so that the filter mouthpieces of the inverted row of cigarettes 348 face in the same direction as the filter mouthpieces of the non-inverted cigarettes. As shown in FIG. 4, the filter disk 336 of the mouthpiece forming part of a filter cigarette 348 of unit length abuts against the concealed end of the plain cigarette 304. Such disk 336 cannot move because it is bonded to the inner side of the tube B/2. The filter plug 313*a* of unit length is located at the free end of the respective tube B/2 and is separated from the filter disk 336 by a clearance or gap of predetermined width which, in the illustrated embodiment, exceeds the axial length of the plug 313*a*.

The placing of filter disks 336 into the spaces between the elements of the groups G on the wrapping conveyor 344 is desirable because, were the disks 336 placed onto the assembly conveyor 319, it would be difficult to hold them against tilting during transport to and through the wrapping station. By inserting the disks 336 shortly or immediately before the conversion of uniting bands B into tubes, it is possible to hold the disks 336 by suction on the heads of holders 366 of the transfer conveyor 343, a mode of holding which has been found to be best suited for proper transport of thin disk-shaped filter elements. The filter disks 336 are too thin to be properly retained by suction or by mechanical means during sidewise movement in a flute or the like. On the other hand, the retention of relatively long plain cigarettes or filter plugs in the flutes of a drum-shaped conveyor present no problems.

The provision of holding means which engage one end face of each filter disk 336 renders it possible to assemble the improved filter mouthpiece in machines which embody many presently used components for reliable transport and manipulation of relatively long plain cigarettes, other tobacco rod sections and/or filter rod sections.

Once the filter disks 336 are inserted into the flutes 378 of the wrapping conveyor 344, they are attracted by suction to the adjacent end faces of the respective plain cigarettes 304 so that they cannot leave the flutes under the action of centrifugal force or gravity. The arrangement is such that the suction heads of holders 366 are disconnected from the suction generating device 377 not earlier than when the conduits 373, 374 begin to draw air through the plain cigarettes 304 in the flutes 378 so that the filter disks 336 are held by suction during insertion into the flutes 378 as well as during conversion of the respective uniting bands B into tubes which unite the rod-shaped components 304, 336, 313, 336, 304 into filter cigarettes 347 of double unit length.

During smoking of a filter cigarette 348, the respective filter disk 336 (see FIG. 4) accumulates nicotine, tar and other harmful substances so that its volume increases. Such expansion of the filter disk 336 is desirable in order to insure that its filaments can intercept large quantities of deleterious ingredients of tobacco smoke. This explains the desirability of placing the filter plug 313*a* at a certain distance from the filter disk 336. In the absence of a clearance between the elements 313*a*, 336 of the mouthpiece shown in FIG. 4, the filter disk 336 would be likely to become clogged so that it could not absorb additional tar and/or nicotine.

An important advantage of the improved method and apparatus, is that the filter mouthpiece with one or more filter disks therein can be manufactured with a high degree of reproducibility in spite of the sensitivity of relatively thin, soft and therefore readily deformable filter disks. Moreover, and since all feeding units and conveyors preferably operate continuously, the output of the machine is just as high as that of a machine for the making of conventional filter mouthpieces with readily manipulable filter plugs but without filter disks. The method and machine can be used for the making of filter mouthpieces of unit length or multiple unit length, for the making of discrete filter mouthpieces, or for the production of smokers' products which embody the improved mouthpieces.

The plugs 313 may consist of acetate fibers and the disk-shaped filters 336 may consist of interlaced glass fibers.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

1. A method of making filter tipped rod-shaped smokers' products, comprising the steps of moving a succession of wrapped tobacco rod sections sideways; placing filter plugs in axial alignment with successive tobacco rod sections and moving the thus obtained groups sideways; placing filter disks between the filter plugs and tobacco rod sections of successive groups, including holding each filter disk by suction at one axial end thereof during introduction between the filter plug and the tobacco rod section of the respective group; and convoluting adhesive-coated uniting bands around the filter plugs, filter disks and portions of tobacco rod sections of successive groups.

2. A method as defined in claim 1, wherein said second placing step further comprises locating each filter disk in abutment with that end of the respective tobacco rod section which faces the axially aligned filter plug.

3. A method as defined in claim 1, wherein said first placing step comprises locating each filter plug in spaced apart position relative to the respective tobacco rod section so that the distance between the filter plug and the aligned tobacco rod section exceeds the thickness of a filter disk.

4. A method as defined in claim 1, wherein said first placing step comprises locating each filter plug in spaced apart position relative to the respective tobacco rod section so that the distance between the filter plug and the tobacco rod section of each group exceeds the thickness of a filter disk, said second placing step further comprising locating each filter disk in spaced apart position relative to the respective filter plug.

5. A method of making filter tipped rod-shaped smokers' products, comprising the steps of moving a succession of wrapped tobacco rod sections sideways; placing filter plugs in axial alignment with successive tobacco rod sections and moving the thus obtained groups sideways; placing filter disks between the filter plugs and tobacco rod sections of successive groups; convoluting adhesive-coated uniting bands around the filter plugs, filter disks and portions of tobacco rod sections of successive groups; and attracting the filter disks to the tobacco rod sections of the respective groups by means of suction acting through the tobacco rod sections, at least prior to start of said convoluting step.

6. In a machine for the production of filter tipped rod-shaped smokers' products of the type wherein a wrapped tobacco rod section is united with at least one coaxial filter plug and at least one coaxial filter disk, a combination comprising a continuously moving wrapping conveyor having a plurality of parallel receiving means and means for continuously moving said receiving means sideways; first, second and third feeding means for respectively supplying to successive receiving means at least one wrapped tobacco rod section, at least one filter plug and at least one filter disk with the latter location between the respective filter plug and the respective tobacco rod section, said third feeding means comprising holders each having a suction head arranged to engage and hold one end face of the respective filter disk during transport to said receiving means; and fourth feeding means for supplying adhesive-coated uniting bands to said receiving means, said wrapping conveyor comprising means for convoluting said uniting bands around the respective filter disks, filter plugs and tobacco rod sections.

7. A combination as defined in claim 6, wherein said wrapping conveyor is a rotary drum and said receiving means are axially parallel flutes provided at the periphery of said drum.

8. A combination as defined in claim 6, wherein said wrapping conveyor comprises retaining means for holding the filter disks in said receiving means against movement out of axial alignment with the respective tobacco rod sections.

9. In a machine for the production of filter tipped rod-shaped smokers' products of the type wherein a wrapped tobacco rod section is united with at least one coaxial filter plug and at least one coaxial filter disk, a combination comprising a continuously moving wrapping conveyor having a plurality of parallel receiving means and means for continously moving said receiving means sideways; first, second and third feeding means for respectively supplying to successive receiving means at least one wrapped tobacco rod section, at least one filter plug and at least one filter disk with the latter located between the respective filter plug and the respective tobacco rod section, said wrapping conveyor comprising retaining means for holding the filter disks in said receiving means against movement out of axial alignment with the respective tobacco rod sections and said retaining means comprising suction-operated means for attracting said filter disks to the respective tobacco rod sections; and fourth feeding means for supplying adhesive-coated uniting bands to said receiving means, said wrapping conveyor further comprising means for convoluting said uniting bands around the respective filter disks, filter plugs and tobacco rod sections.

* * * * *